US009681751B2

(12) United States Patent
Lu

(10) Patent No.: US 9,681,751 B2
(45) Date of Patent: Jun. 20, 2017

(54) ELECTRIC SUPPORT SYSTEM FOR HEADREST

(71) Applicant: Dongguan Weihong Hardware and Plastic Products Co., Ltd., Dongguan (CN)

(72) Inventor: Wei Lu, Dongguan (CN)

(73) Assignee: DONGGUAN WEIHONG HARDWARE AND PLASTIC PRODUCTS CO., LTD., Dongguan (CN)

( * ) Notice: Subject to any disclaimer, the term of this patent is extended or adjusted under 35 U.S.C. 154(b) by 73 days.

(21) Appl. No.: 14/960,689

(22) Filed: Dec. 7, 2015

(65) Prior Publication Data

US 2016/0088945 A1 Mar. 31, 2016

(30) Foreign Application Priority Data

Sep. 8, 2015 (CN) ..... 2015 1 0568033

(51) Int. Cl.
*A47C 7/38* (2006.01)

(52) U.S. Cl.
CPC ..... *A47C 7/38* (2013.01)

(58) Field of Classification Search
None
See application file for complete search history.

(56) References Cited

U.S. PATENT DOCUMENTS

| | | | | |
|---|---|---|---|---|
| 7,862,110 | B2 * | 1/2011 | Rogers | A47C 1/036 297/391 |
| 8,702,173 | B2 * | 4/2014 | Adams | A47C 7/38 297/403 |
| 2016/0157613 | A1 * | 6/2016 | Buchholz | A47C 1/02 297/463.1 |
| 2016/0227933 | A1 * | 8/2016 | Donovan | A47C 1/02 |
| 2016/0227934 | A1 * | 8/2016 | Lu | F16H 21/44 |
| 2016/0331145 | A1 * | 11/2016 | Baumeister | A47C 1/036 |
| 2016/0345740 | A1 * | 12/2016 | Lu | A47C 17/04 |
| 2016/0367033 | A1 * | 12/2016 | Sigmon | A47C 1/02 |

FOREIGN PATENT DOCUMENTS

| | | | | |
|---|---|---|---|---|
| CN | EP 3100644 | A1 * | 12/2016 | A47C 7/38 |

* cited by examiner

*Primary Examiner* — David E Allred
(74) *Attorney, Agent, or Firm* — Shimokaji IP

(57) ABSTRACT

An electric support system for headrest includes first sliders connected with and slid on each other, first and second fasteners, and first to fourth connecting rods; the first and second sliders are respectively fixed to the first fastener and the first connecting rod, an upper end of the first connecting rod and one end of the second connecting rod are respectively connected to the second fastener, one end of the third connecting rod is connected to the first connecting rod, the other end of the third connecting rod is pivotally connected to one end of the fourth connecting rod, the other end of the fourth connecting rod is pivotally connected to the first slider, the other end of the second connecting rod is pivotally connected to the third connecting rod between the two ends thereof, and a linear drive device having an output shaft for driving the first connecting rod.

10 Claims, 9 Drawing Sheets

ELECTRIC SUPPORT SYSTEM FOR HEADREST

RELATED APPLICATIONS

This application claims the benefit of priority to Chinese Patent Application No. 201510568033.0 filed in Sep. 8, 2015, which is hereby incorporated by reference in its entirety.

FIELD OF THE INVENTION

The present invention relates to a field of furniture parts, more particularly to an electric support system for steadily adjusting a tilting angle of a sofa headrest.

BACKGROUND OF THE INVENTION

Commonly, angles of a headrest of a sofa can be adjusted to meet the requirement of the customers. One of the new achievement manners is to set a headrest support system connected with the headrest in the seat or sofa, the headrest support system consists of two fasteners and a plurality of mutually pivoted rods configured between the two fasteners, one fastener thereof is fixed to the body of the sofa, the other fastener is fixed to the sofa headrest, the plurality of rods can be mutually turned to drive one fastener to rotate relative to the other one, thereby adjusting the tilting angle of the sofa headrest. Further, the rods are urged to be turned manually or electrically.

However, such a headrest support system has some drawbacks, the positions of the rods connected between the two fasteners are changeable, and the structure thereof is weak in a transverse direction. As the rods need to withstand the weight of human head, so these rods may swing when adjusting the tilting angle thereof, and result in damage.

Thus it's necessary to provide an electric support system for steadily adjusting a tilting angle of a sofa headrest.

SUMMARY OF THE INVENTION

One objective of the present invention is to provide an electric support system for steadily adjusting and locating the headrest of sofa.

To achieve the above objective, an electric support system for headrest is provided, which includes a linear drive device and at least one adjusting assembly, the adjusting assembly includes a sliding rail, a first fastener, a second fastener, a first connecting rod, a second connecting rod, a third connecting rod, and a fourth connecting rod; wherein the sliding rail includes a first slider and a second slider connected with and slid on each other, the first slider is fixed to the first fastener, the second slider is fixed to a lower end of the first connecting rod, an upper end of the first connecting rod and one end of the second connecting rod are respectively pivotally connected to two spaced positions of one end of the second fastener, one end of the third connecting rod is pivotally connected to the first connecting rod with a pivot configured between the two ends of the first connecting rod, the other end of the third connecting rod is pivotally connected to one end of the fourth connecting rod, the other end of the fourth connecting rod is pivotally connected to the first slider, the other end of the second connecting rod is pivotally connected to the third connecting rod with a pivot configured between the two ends of the third connecting rod, the linear drive device is connected to the first fastener and has an output shaft that is capable of linearly sliding, and the output shaft is connected to the first connecting rod.

In comparison with the prior art, the electric support system for headrest of the present invention is provided with the linear drive device and at least one adjusting assembly. After the first fastener is fixed on the sofa body, and the second fastener is fixed on the headrest, the headrest adjustment is implemented by the output shaft of the linear drive device. Concretely, the linear drive device is started to protrude or drawn back its output shaft, which is connected with the first connecting rod and directly actuates the first connecting rod to slide up or down, and subsequently actuates the second, third and fourth connecting rods to unfold or fold, so as to rotate the second fastener frontward or rearward relative to the first fastener by the combined effect of the first and second connecting rods, thereby the tilting angle and position of the sofa headrest can be adjusted automatically, without manual operation to turn the headrest. Furthermore, as the first fastener is fixed to the first slider of the sliding rail, and the first connecting rod is fixed to the second slider of the sliding rail, so the sliding rail not only guide the first connecting rod but also support the all connecting rods, and the connecting rods would not swing when being pivoted or rotated, thereby improving the stability of the electric support system for headrest.

Preferably, the number of the adjusting assembly is two, and the linear drive device is configured between the two adjusting assemblies. Two adjusting assemblies are provided to strengthen the connection between the sofa and the headrest, increase the carrying capacity of the headrest, and then adjust the headrest more steadily and reliably.

Concretely, the electric support system for headrest, further comprises a fixing rod and a drive rod, two ends of the fixing rod are respectively fixed to two first fasteners of the two adjusting assemblies, two ends of the drive rod are respectively fixed to two first connecting rods of the two adjusting assemblies, the linear drive device is pivotally connected to the fixing rod, and the output shaft is pivotally connected to the drive rod. The fixing rod is configured for positioning the linear drive device between the two adjusting assemblies, and the drive rod is configured for driving two adjusting assemblies synchronously.

More concretely, the first fastener and the first connecting rod are respectively fixed at two sides of the sliding rail, the two ends of the drive rod are respectively configured with a connecting component, one end of the connecting component is fixed to the drive rod, and the other end of the connecting component is extended around the sliding rail and then fixed to the first connecting rod. As the first fastener and the first connecting rod are respectively fixed at two different sides of the sliding rail, so a connecting component is needed to fix the drive rod configured between the two adjusting assemblies to the first connecting rod located at the outside of the sliding rail.

Preferably, the second fastener, the second connecting rod, the third connecting rod, the fourth connecting rod and the sliding rail are configured at the same side of the first connecting rod.

Preferably, the second connecting rod, the third connecting rod, and the fourth connecting rod are bended arc rods, and the first connecting rod is in a shape of a long strip.

Preferably, an arc stopping slot is opened in a top of the first connecting rod, a stopping pin is configured on the second fastener, and the stopping pin is slid in the stopping slot. The stopping pin matches with the stopping slot to limit the rotating range of the second fastener relative to the first fastener, so as to limit the angle range for adjusting the headrest.

Preferably, the second fastener comprises a rod body and a pivoting portion fixed to one end of the rod body and bent relative to the rod body, the upper end of the first connecting rod is pivotally connected to a position where the rod body is connected with the pivoting portion, and the second rod is pivotally connected to the pivoting portion. As the first connecting rod and the second connecting rod are respectively connected to different portions of the second fastener, so the second fastener can be turned frontward or rearward by the combined effect of the first and second connecting rods.

Preferably, the sliding rail further comprises an embedded component and a plurality of balls, a rolling groove is formed at each side of the first slider, the embedded component is fixed to the first slider, the plurality of balls are configured at two sides of the embedded component in two separate rows, the balls are rollingly received in the rolling groove, the second slider shields the first slider, the embedded component, and the balls, and sides of the second slider cover a portion of each ball.

Preferably, the linear drive device comprises a linear motor.

BRIEF DESCRIPTION OF THE DRAWINGS

The accompanying drawings facilitate an understanding of the various embodiments of this invention. In such drawings.

DETAILED DESCRIPTION OF ILLUSTRATED EMBODIMENTS

Figure 1:
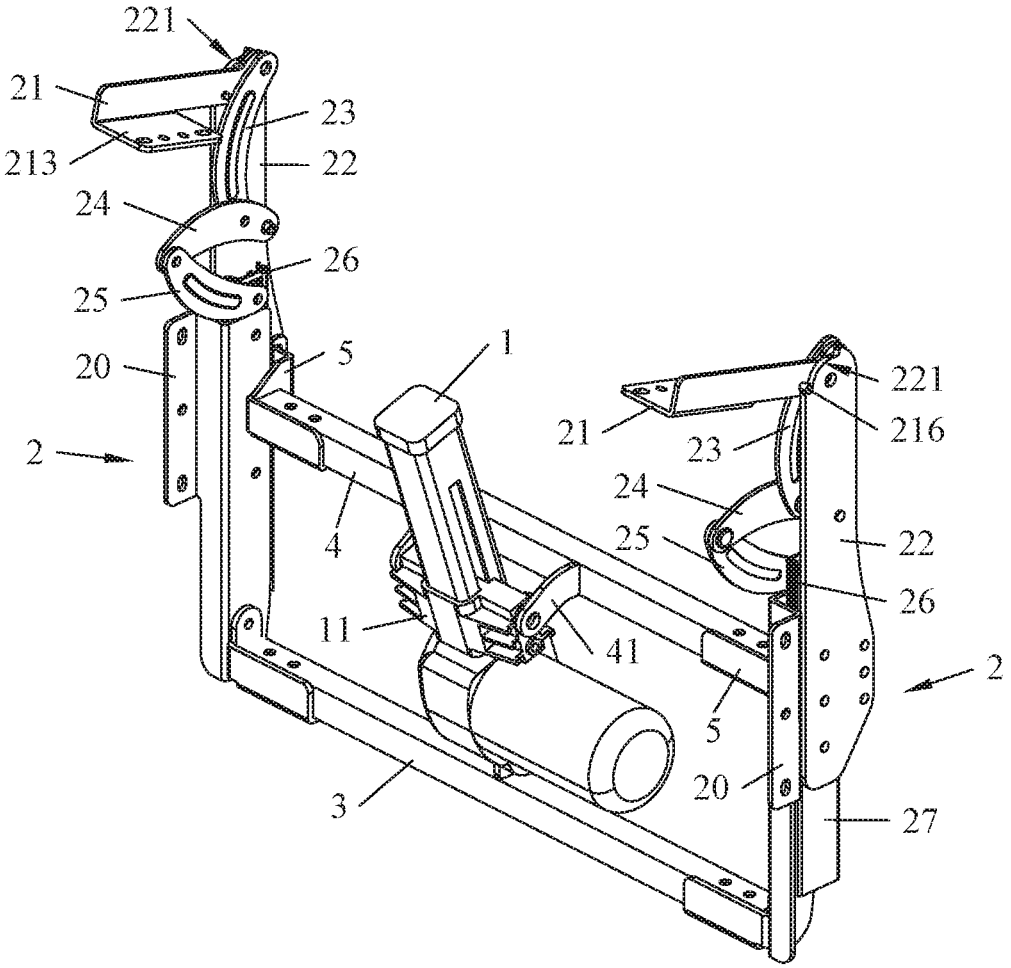
FIG. 1 is a perspective view of an electric support system for headrest of the present invention.

As illustrated in FIGS. 1-4, an electric support system for headrest is provided, which can be mounted in a sofa and connected with a headrest so as to automatically adjust the headrest to any angle, or any position.

The electric support system for headrest includes a linear drive device 1 and at least one adjusting assembly 2, the adjusting assembly 2 includes a sliding rail, a first fastener 20, a second fastener 21, a first connecting rod 22, a second connecting rod 23, a third connecting rod 24, and a fourth connecting rod 25. The first fastener 20 is fixed to the sofa body, and the second fastener 21 is fixed to the headrest of sofa. The sliding rail includes a first slider 26 and a second slider 27 connected with and slid on each other, the first slider 26 is fixed to the first fastener 20, the second slider 27 is fixed to a lower end of the first connecting rod 22, an upper end of the first connecting rod 22 and one end of the second connecting rod 23 are respectively pivotally connected to two spaced positions of one end of the second fastener 21, one end of the third connecting rod 24 is pivotally connected to the first connecting rod 22 with a pivot configured between the upper and lower ends of the first connecting rod 22, the other end of the third connecting rod 24 is pivotally connected to one end of the fourth connecting rod 25, the other end of the fourth connecting rod 25 is pivotally connected to the first slider 26, and the other end of the second connecting rod 23 is pivotally connected to the third connecting rod 24 with a pivot configured between the two ends of the third connecting rod 24. The linear drive device 1 is connected to the first fastener 20 and has an output shaft 11 that is capable of linearly sliding, and the output shaft 11 is connected to the first connecting rod 22.

In this embodiment, concretely, the number of the adjusting assembly 2 is two, the electric support system for headrest further includes a fixing rod 3 and a drive rod 4, and the linear drive device 1 is configured between the two adjusting assemblies 2 via the fixing rod 3 and the drive rod 4. concretely, the linear drive device is a linear motor, and the output shaft of the linear drive device 1 is capable of linearly reciprocating movement.

As for each adjusting assembly 2, the second connecting rod 23, the third connecting rod 24, and the fourth connecting rod 25 are bended arc rods, and the first connecting rod 22 is in a shape of a long strip. As for the first connecting rod 22, the second fastener 21, the second connecting rod 23, the third connecting rod 24, the fourth connecting rod 25 and the sliding rail are configured at the same side of the first connecting rod 22. As for the sliding rail, the first fastener 20 and the first connecting rod 22 are respectively fixed to two sides of the sliding rail.

Figure 4:
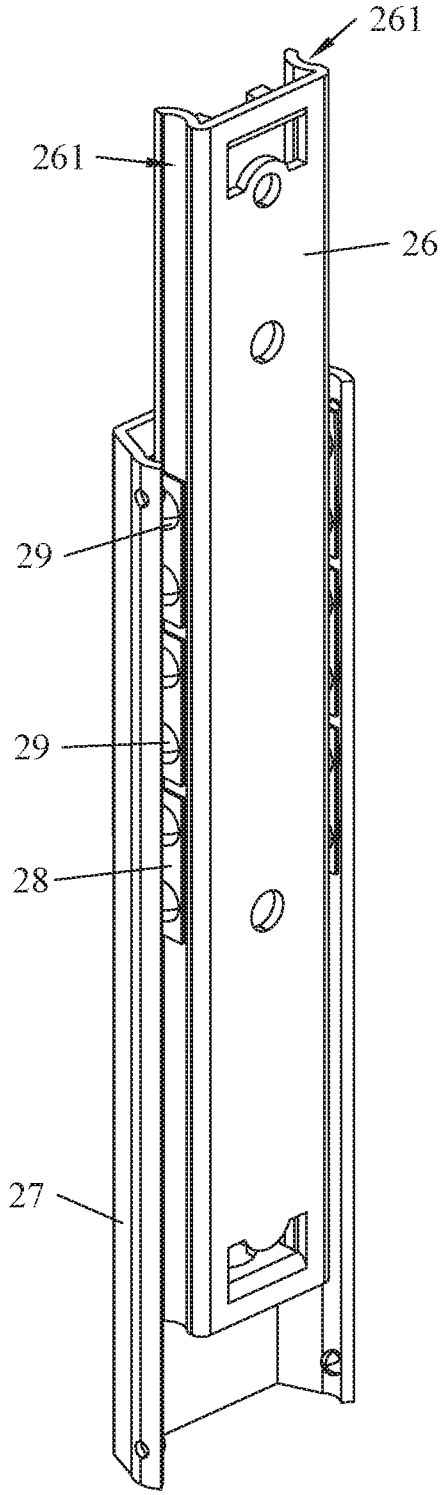
FIG. 4 is a perspective view of a sliding rail of the electric support system for headrest of the present invention.
Figure 5:
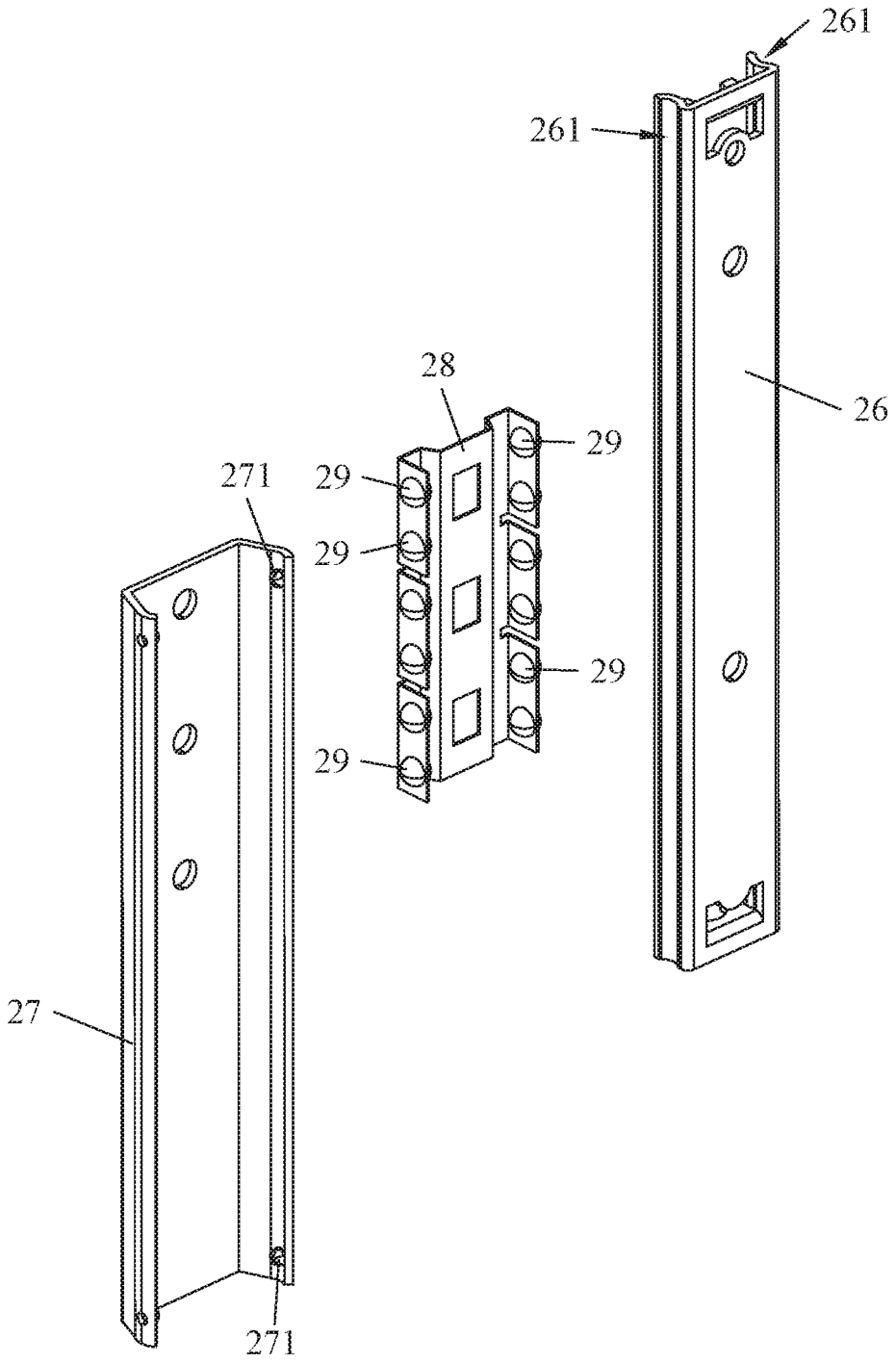
FIG. 5 is an exploded view of a sliding rail of the electric support system for headrest of the present invention.

Referring to FIGS. 4 and 5, the sliding rail further includes an embedded component 28 and a plurality of balls 29. A rolling groove 261 is formed at each side of the first slider 26 along a length direction of the first slider 26, the embedded component 28 is fixed to the first slider 26, the cross-section of the embedded component 28 is in a shape of "U", and two bent sides thereof respectively correspond to the two rolling groove 261 of the first slider 26. The two bent sides of the embedded component 28 respectively have a row of holes, the plurality of balls 29 are configured at two sides of the embedded component 28 in two separate rows, each ball 29 is rollingly received in one hole, and a portion of each ball 29 passes through the embedded component 28 and then is received in the rolling groove 261. The cross-section of the second slider 27 is also in a shape of "U", the second slider 27 shields the first slider 26, the embedded component 28, and the balls 29, and side portions of the second slider 27 bend and then cover a portion of each ball 29. The second slider 27 and the first slider 26 are connected to be a whole via the bent side portions of the second slider 27, and the balls 29 can roll freely between the first slider 26 and the second slider 27, thus the first slider 26 can slide relative to the second slider 27 with small friction force. Two stopping portions 271 are respectively configured on the upper and lower ends of the inner wall of each side portion of the second slider 27, the ball 29 is stopped by the stopping portions 271 so as to limit the sliding range of the first slider 26 relative to the second slider 27. In this embodiment, only a type of sliding rail is described, while the structure of the sliding rail is not limited.

Figure 6:
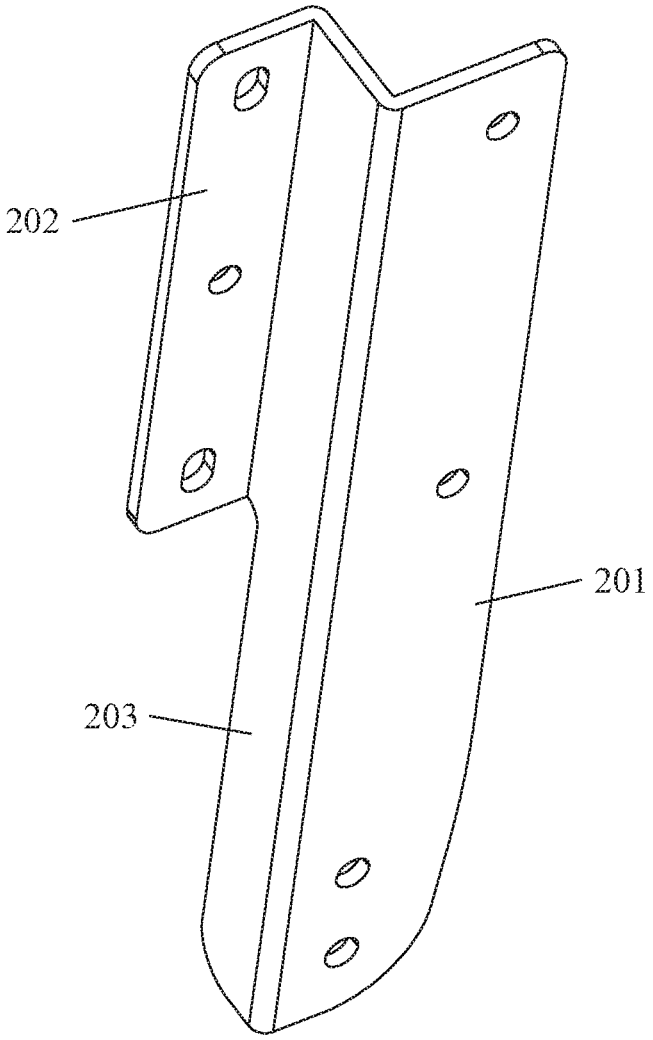
FIG. 6 is a perspective view of a first fastener of the electric support system for headrest of the present invention.

As shown in FIG. 6, the first fastener 20 includes a first fixing portion 201 and a second fixing portion 202 that are parallel to each other, and a connecting portion 203 connected between the first fixing portion 201 and the second fixing portion 202. The first slider 26 is fixed to the first fixing portion 201, the connecting portion 203 is located at a side of the sliding rail, and the second fixing portion 202 is fixed to the sofa body via rivets. The first fixing portion 201, the second fixing portion 202, and the third fixing portion 203 are formed integrally.

Figure 2:
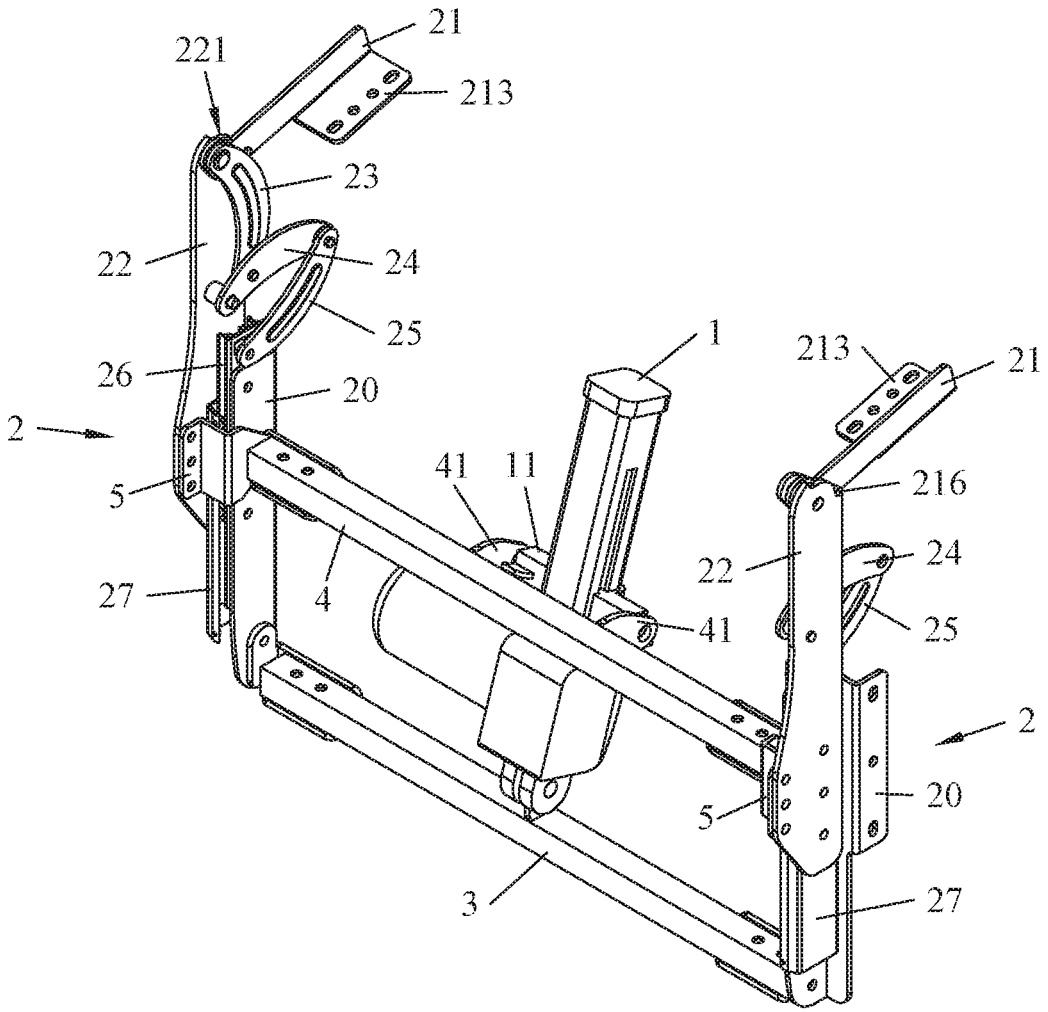
FIG. 2 is another perspective view of the electric support system for headrest of the present invention.
Figure 3:
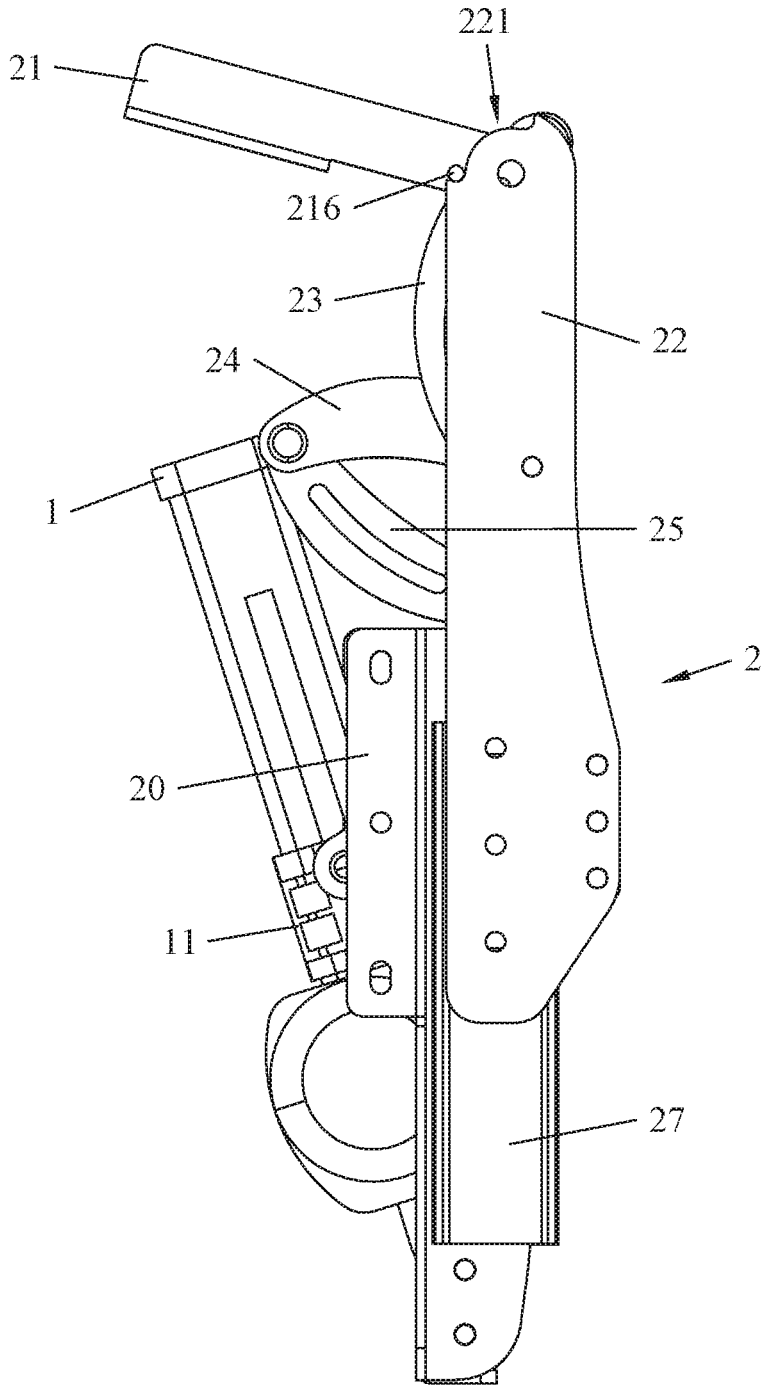
FIG. 3 is a side view of the electric support system for headrest of the present invention.
Figure 7:
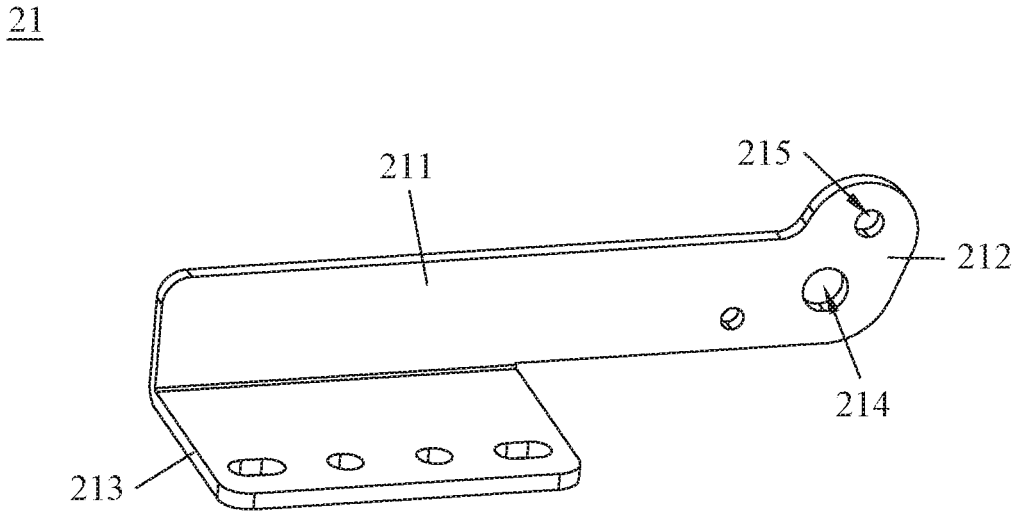
FIG. 7 is a perspective view of a second fastener of the electric support system for headrest of the present invention.

Referring to FIGS. 1, 2 and 7, the second fastener 21 includes a rod body 211 and a pivoting portion 212 fixed to one end of the rod body 211 and bent relative to the rod body 211, the other end of the rod body 211 is fixed with a fixing portion 213, the fixing portion 213 is fixed to the headrest of sofa with rivets. A first pivoting hole 214 is opened in a position where the rod body 211 is connected with the pivoting portion 212, and a second pivoting hole 215 is opened in the pivoting portion 212. The upper end of the first connecting rod 22 is pivotally connected in the first pivoting hole 214, and the second connecting rod 23 is pivotally connected in the second pivoting hole 215. The rod body 211, the pivoting portion 212, and the fixing portion 213 are formed integrally. As the first connecting rod 22 and the second connecting rod 23 are respectively connected in different pivoting holes of the second fastener 21, so the second fastener 21 can be urged to be turned frontward or rearward by the combined effect of the first and second connecting rods 22, 23.

Referring to FIGS. 1 and 2, an arc stopping slot 221 is opened in a top of the first connecting rod 22, a stopping pin 216 inserted into the stopping slot 221 is configured on the second fastener 21, and the stopping pin 216 is slid in the stopping slot 221 when the second fastener 21 is rotated relative to the first connecting rod 22. The stopping pin 216 matches with the stopping slot 221 to limit the rotating range of the second fastener 21 relative to the first fastener 22, so as to limit the angle range for adjusting the headrest.

Any two pivotally connected components of the electric support system for headrest are connected by the rivet, and all the axes of the rivets are parallel.

Two ends of the fixing rod 3 are respectively fixed to two first fasteners 20 of the two adjusting assemblies 2. The drive rod 4 is located above the fixing rod 3 and subparallel to the fixing rod 3, and two ends of the drive rod 4 are respectively fixed to two first connecting rods 22 of the two adjusting assemblies 2. Concretely, the two ends of the drive rod 4 are respectively configured with a connecting component 5, one end of the connecting component 5 is fixed to the drive rod 4, and the other end of the connecting component 5 is extended around the sliding rail and then fixed to the first connecting rod 22. As the first fastener 20 and the first connecting rod 22 are respectively fixed at the inner side and the outer side of the sliding rail, so the connecting component 5 is needed to fix the drive rod 4 to the first connecting rod 22, and then the drive rod 4 is capable of driving the first connecting rod 22 without interference of the first fastener 20.

A lower end of the linear drive device 1 is pivotally connected to a centre position of the fixing rod 3. Two pivoting arms 41 are protruded and formed on the drive rod 4, which are positioned at two sides of the output shaft 11 and pivotally connected to the output shaft 11. The output shaft 11 can drive the first connecting rod 22 to slide up and down through the drive rod 4, and the two first connecting rods 22 of the two adjusting assemblies 2 can move synchronously.

Figure 8:
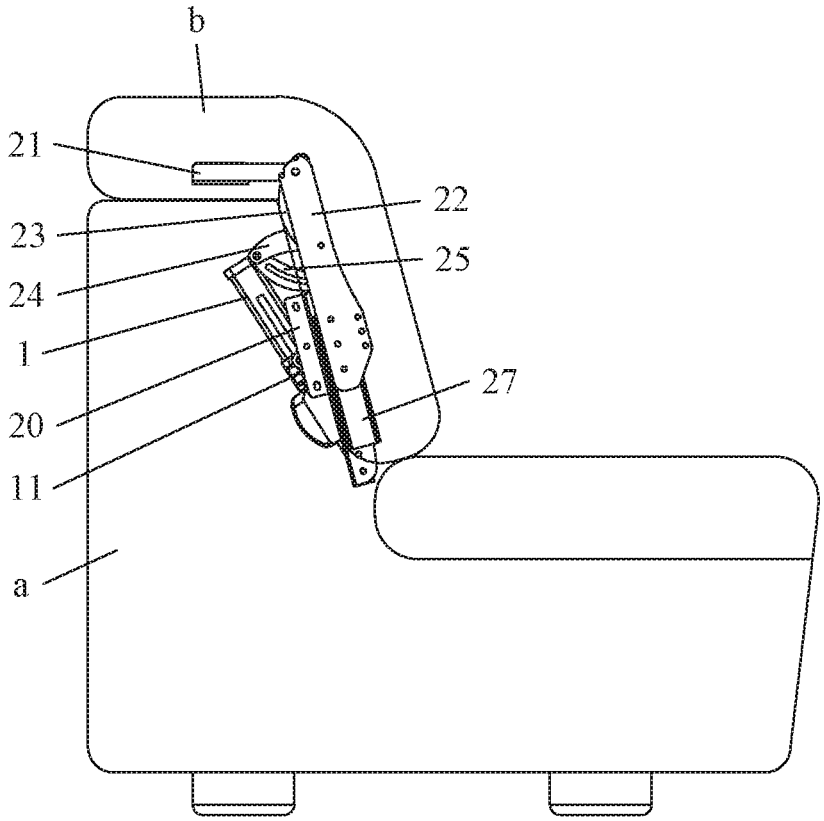
FIG. 8 is a schematic view of the electric support system for headrest mounted in the sofa.
Figure 9:
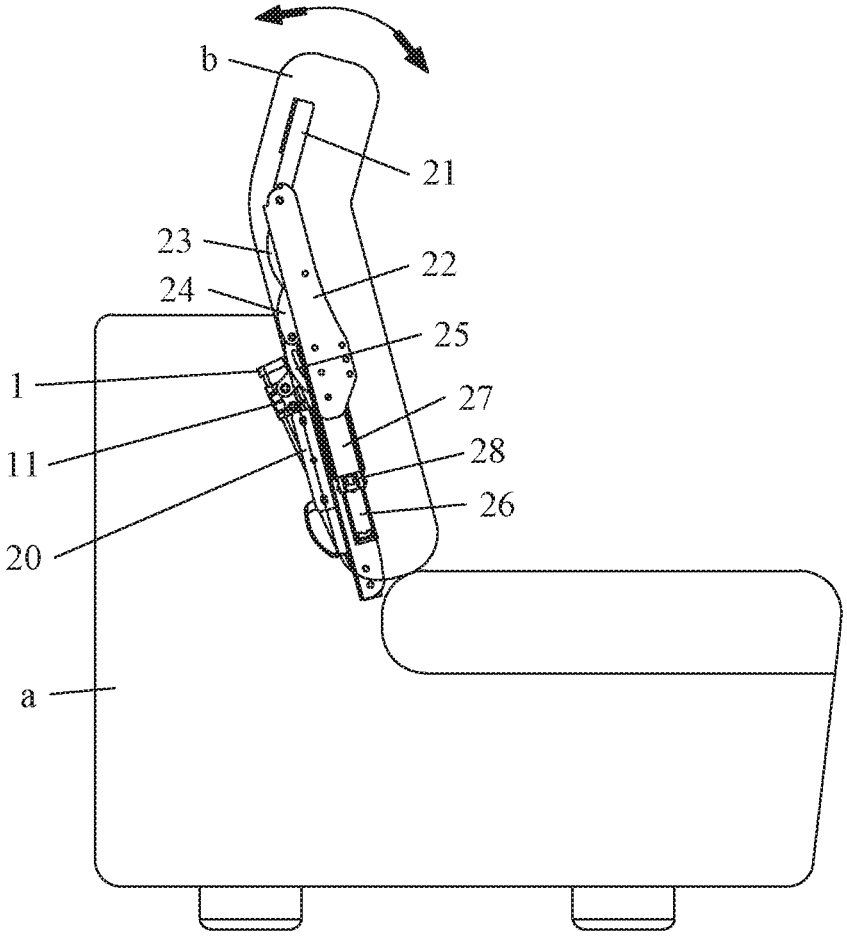
FIG. 9 is a schematic view showing the headrest of the FIG. 8 being adjusted to a vertical position.

Referring to the above figures and FIGS. 8-9, the operation process for adjusting the tilting angle of the headrest will be described as follow. The first fastener 20 is fixed to the sofa body a, the second fastener 21 is fixed to the headrest b. As shown in FIG. 8, the output shaft 11 of the linear drive device 1 is located at a lower position, and the headrest b is also located at a lower position.

When the tilting angle of the headrest b is needed to be adjusted, starting the linear drive device 1, so that the output shaft 11 slides upward, the output shaft 11 push the drive rod 4 to move upward so as to drive the first connecting rod 22 to slide upward. The first connecting rod 22 is slid via the sliding of the first slider 26 relative to the second slider 27. When the first connecting rod 22 is sliding upward, the second connecting rod 23, the third connecting rod 24, and the fourth connecting rod 25 are pivotally rotated and synchronously unfolded. During the unfolding process, the pivoting portion 212 of the second fastener 21 where the second connecting rod 23 is connected is drawn downward relative the pivoting hole 214 where the first connecting rod 22 is connected, thereby the second fastener 21 can rotate forward so as to change the angle of the headrest b by the combined effect of the first and second connecting rods 22, 23, as shown in FIG. 9.

In comparison with the prior art, the angle of the headrest of the headrest can be automatically adjusted by applying a linear drive device 1 to push the second fastener 21 without manual operation. Furthermore, the sliding rail not only guide the first connecting rod 22 but also support all the connecting rods, and the connecting rods would not swing when being pivoted or rotated, thereby improving the stability of the electric support system for headrest.

While the invention has been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention.

What is claimed is:

1. An electric support system for headrest, comprising a linear drive device and at least one adjusting assembly, the adjusting assembly comprising a sliding rail, a first fastener, a second fastener, a first connecting rod, a second connecting rod, a third connecting rod, and a fourth connecting rod;

wherein the sliding rail comprises a first slider and a second slider connected with and slid on each other, the first slider is fixed to the first fastener, the second slider is fixed to a lower end of the first connecting rod, an upper end of the first connecting rod and one end of the second connecting rod are respectively pivotally connected to two spaced positions of one end of the second fastener, one end of the third connecting rod is pivotally connected to the first connecting rod with a pivot configured between the two ends of the first connecting rod, the other end of the third connecting rod is pivotally connected to one end of the fourth connecting rod, the other end of the fourth connecting rod is pivotally connected to the first slider, the other end of the second connecting rod is pivotally connected to the third connecting rod with a pivot configured between the two ends of the third connecting rod, the linear drive device is connected to the first fastener and has an output shaft that is capable of linearly sliding, and the output shaft is connected to the first connecting rod.

2. The electric support system for headrest according to claim 1, wherein the number of the adjusting assembly is two, and the linear drive device is configured between the two adjusting assemblies.

3. The electric support system for headrest according to claim 2, further comprises a fixing rod and a drive rod, two ends of the fixing rod are respectively fixed to two first fasteners of the two adjusting assemblies, two ends of the drive rod are respectively fixed to two first connecting rods of the two adjusting assemblies, the linear drive device is pivotally connected to the fixing rod, and the output shaft is pivotally connected to the drive rod.

4. The electric support system for headrest according to claim 3, wherein the first fastener and the first connecting rod are respectively fixed at two sides of the sliding rail, the two ends of the drive rod are respectively configured with a connecting component, one end of the connecting component is fixed to the drive rod, and the other end of the connecting component is extended around the sliding rail and then fixed to the first connecting rod.

5. The electric support system for headrest according to claim 1, wherein the second fastener, the second connecting rod, the third connecting rod, the fourth connecting rod and the sliding rail are configured at the same side of the first connecting rod.

6. The electric support system for headrest according to claim 1, wherein the second connecting rod, the third connecting rod, and the fourth connecting rod are bended arc rods, and the first connecting rod is in a shape of a long strip.

7. The electric support system for headrest according to claim 1, wherein an arc stopping slot is opened in a top of the first connecting rod, a stopping pin is configured on the second fastener, and the stopping pin is slid in the stopping slot.

8. The electric support system for headrest according to claim 1, wherein the second fastener comprises a rod body and a pivoting portion fixed to one end of the rod body and bent relative to the rod body, the upper end of the first connecting rod is pivotally connected to a position where the rod body is connected with the pivoting portion, and the second rod is pivotally connected to the pivoting portion.

9. The electric support system for headrest according to claim 1, wherein the sliding rail further comprises an embedded component and a plurality of balls, a rolling groove is formed at each side of the first slider, the embedded component is fixed to the first slider, the plurality of balls are configured at two sides of the embedded component in two separate rows, the balls are rollingly received in the rolling groove, the second slider shields the first slider, the embedded component, and the balls, and sides of the second slider cover a portion of each ball.

10. The electric support system for headrest according to claim 1, wherein the linear drive device comprises a linear motor.

* * * * *